US009512994B2

(12) United States Patent
Rashidi Doust

(10) Patent No.: US 9,512,994 B2
(45) Date of Patent: Dec. 6, 2016

(54) FIRE RATED RECESSED LIGHTING ASSEMBLY

(71) Applicant: ELITE LIGHTING, Commerce, CA (US)

(72) Inventor: Hamid Rashidi Doust, Beverly Hills, CA (US)

( * ) Notice: Subject to any disclaimer, the term of this patent is extended or adjusted under 35 U.S.C. 154(b) by 4 days.

(21) Appl. No.: 14/935,307

(22) Filed: Nov. 6, 2015

(65) Prior Publication Data

US 2016/0238226 A1 Aug. 18, 2016

Related U.S. Application Data

(63) Continuation-in-part of application No. 14/677,979, filed on Apr. 3, 2015.

(60) Provisional application No. 62/116,871, filed on Feb. 16, 2015, provisional application No. 62/239,180, filed on Oct. 8, 2015.

(51) Int. Cl.

| | |
|---|---|
| ***F21V 25/00*** | (2006.01) |
| ***F21V 25/12*** | (2006.01) |
| ***F21V 23/06*** | (2006.01) |
| ***F21S 8/02*** | (2006.01) |

(52) U.S. Cl.

CPC ..... *F21V 25/125* (2013.01); *F21S 8/02* (2013.01); *F21S 8/026* (2013.01); *F21V 23/06* (2013.01); *F21Y 2115/10* (2016.08)

(58) Field of Classification Search

CPC ..... F21V 25/00; F21V 25/10

See application file for complete search history.

(56) References Cited

U.S. PATENT DOCUMENTS

| | | | | |
|---|---|---|---|---|
| 6,105,334 A * | 8/2000 | Monson | ..... | F21S 8/02 52/232 |
| 6,226,939 B1 * | 5/2001 | Atkins | ..... | F21S 8/02 52/232 |
| 6,357,891 B1 * | 3/2002 | Newbold | ..... | F21S 8/02 362/147 |

(Continued)

FOREIGN PATENT DOCUMENTS

| | | |
|---|---|---|
| EP | 2484968 | 8/2012 |
| GB | 2270936 | 3/1994 |

(Continued)

OTHER PUBLICATIONS

U.S. Appl. No. 14/555,029, filed on Nov. 00, 2014, entitled "Downlight Firestop."

*Primary Examiner* — Renee Chavez
*Assistant Examiner* — Christopher E Dunay
(74) *Attorney, Agent, or Firm* — Payam Moradian

(57) ABSTRACT

Provided is a fire rated or resistant recessed lighting assembly including a metal housing inside of which a lighting unit is placed, the housing being fire resistant for 120 minutes when tested according ASTM E119-12a without a protective fire resistant cover on outside of the housing. The fire resistant recessed lighting assembly can include a metal housing inside of which a light is placed and one or both of: i) an object made of a fire resistant material, such as an intumescent material, placed inside of the housing in between a trim and a closed end of the housing; and ii) an ring made of a fire resistant material, such as an intumescent material, placed outside of the housing, wherein in event of a fire, the intumescent material expands to slow spread of the fire.

16 Claims, 14 Drawing Sheets

(56) References Cited

U.S. PATENT DOCUMENTS

| | | | | |
|---|---|---|---|---|
| 7,320,536 | B2 * | 1/2008 | Petrakis | F21V 25/00 362/147 |
| 7,670,033 | B2 * | 3/2010 | Steer | F21S 8/02 362/267 |
| 2002/0131271 | A1 * | 9/2002 | Schubert | F21V 21/04 362/365 |
| 2008/0165545 | A1 * | 7/2008 | O'Brien | F21S 8/02 362/364 |

FOREIGN PATENT DOCUMENTS

| | | |
|---|---|---|
| GB | 2415245 | 12/2005 |
| GB | 254449 | 5/2009 |

* cited by examiner

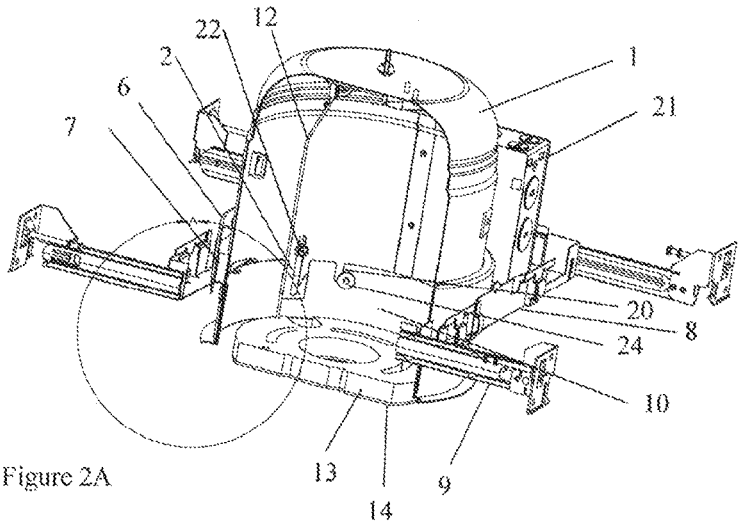
Figure 2A
Figure 2B
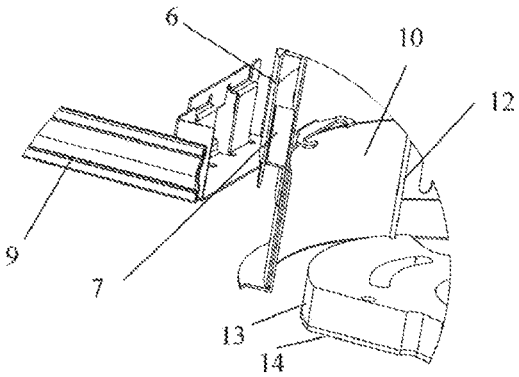

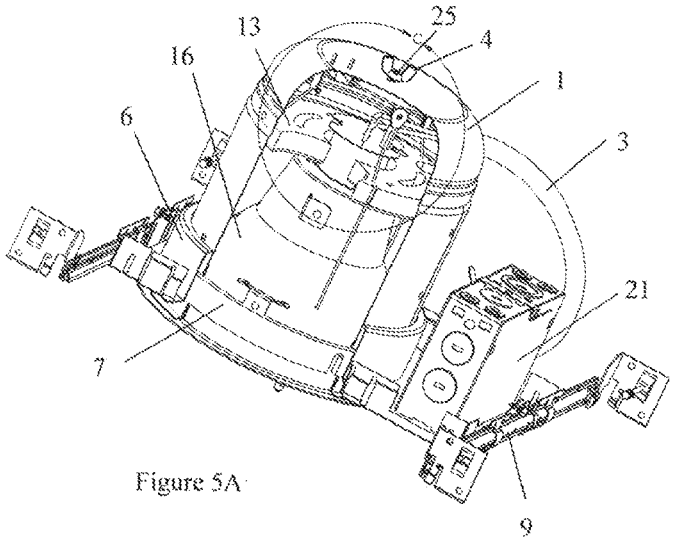
Figure 5A
Figure 5B
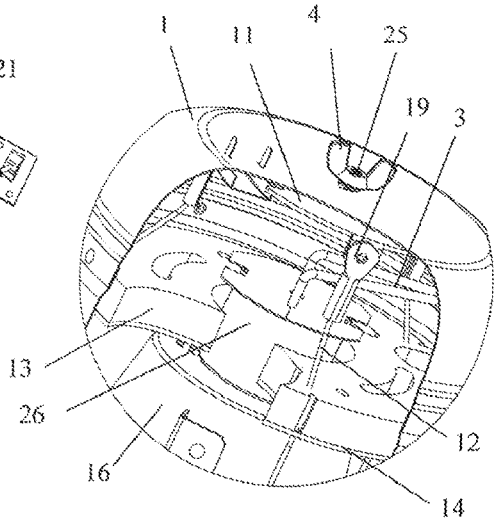

FIRE RATED RECESSED LIGHTING ASSEMBLY

CROSS-REFERENCE

The present application is a continuation-in-part (CIP) of U.S. patent application Ser. No. 14/677,979 filed on Apr. 3, 2015, which claims the benefit of provisional application No. 62/116,871, filed on Feb. 16, 2015, and also claims benefit of provisional application No. 62/239,180, filed on Oct. 8, 2015, which are all incorporated herein by reference in their entirety.

BACKGROUND SECTION OF THE INVENTION

Recessed luminaries are placed in the ceiling and there is a need that they contain a fire for between 60 to 120 minutes, otherwise a fire from one lighting assembly in a ceiling can spread to a floor above the ceiling where the lighting assembly is placed.

To address the issue of fire rated lighting assembly, generally an enclosure is built around a recessed light. These enclosures include a fire box that surrounds the recessed light. The problem with fire boxes is that multiple subcontractors may be needed to install a recessed light. The fire boxes may not be designed for standard 2×8 joist construction, requiring larger joist that may be more expensive to construct. Due to the size of the box, recessed lights cannot be installed in close proximity to each other or close to the wall. The fire box can only be installed along a long axis. Furthermore, requiring installing the fire box first and then installing the recessed light inside the box can cause delays in construction and increases the overall cost of labor and material. The use of a fire box may use additional materials such as drywall, caulk, gaskets, hats and joint tape. Lastly, because a box must be made from drywall around each recessed light, additional clearance is needed, thereby limiting location.

There is a need in the art for a fire rated recessed lighting assembly that addresses the above problems.

SUMMARY SECTION OF THE INVENTION

Provided is a fire resistant or rated recessed lighting assembly comprising a metal housing inside of which a source of light is placed (configured for placement of a source of light), the lighting assembly being fire resistant for 60 or 120 minutes when tested according ASTM E119-12a without a protective fire resistant cover on outside of the housing. A fire resistant material, such as an intumescent material, can be placed inside and/or outside of the housing.

Provided is a fire rated or resistant recessed lighting assembly comprising: a) a metal housing inside of which a light is placed, the metal housing having an open and a closed end; b) a trim (a decorative trim and/or an adapter); and c) an object (element) made of a fire resistant material, such as an intumescent material placed inside of the housing in between the closed end of the housing and the trim; wherein in event of a fire, the fire resistant material slows spread of fire. If the fire resistant material is an intumescent material, then the intumescent material expands to slow spread of the fire. The object (fire resistant element) can span the diameter of the housing just short of touching the housing. The trim can be a decorative trim that may or may not also act as a reflector. The trim can be a support trim (an adapter), which may have a tubular section that fits inside of the housing, and a flange that extends in annular relationship outside of the opening of the housing. The light assembly can further comprise wires attached to top of the housing, to which wires the intumescent object is slidably or movably attached, wherein in event of a fire, the decorative trim melts and the intumescent material slides or moves down the wires. The light assembly can further comprise stoppers attached to an end of the wires for stopping the intumescent object from further sliding down. The light assembly can further comprise a bracket for attaching the wires to the top of the housing. The intumescent object can be a disc made of an intumescent material. The intumescent disc can have a central opening. A socket in electronic communication with an electric cable from a junction box on outside of the housing can be placed inside of the housing, with a least a portion of the socket or the electric cable passing through the central opening of the disc inside of the housing. Heat vents can be present on the intumescent disc. An intumescent ring can be placed outside of the housing to cover one or more openings for attaching the housing to a structure outside of the housing. The disc can be slidably attached to the closed end of the housing with wires. One or more metal wires can be attached to the closed end of the housing, the intumescent disc slidably attached to the wires. A support can be attached to the open end of the housing. A cover can be used for covering the intumescent ring to sandwich the intumescent ring in between the cover and the housing. A metal support below the intumescent disc can be used, the metal disc having openings through which the wires pass to allow the metal support and the intumescent disc slide. One or more stoppers attached at a second end of the wire can be used to stop the metal support from falling out when the metal support reaches the second end of the wire. A metal frame for attaching the housing through a connection with the slot of the housing can be used. A cover can be used for covering the intumescent ring to sandwich the intumescent ring in between the cover and the housing.

Provided is a fire rated or resistant recessed lighting assembly comprising: a) a metal housing inside of which a light is placed; and b) a ring made of an intumescent material placed outside of the housing, wherein in event of a fire, the intumescent material expands to slow spread of the fire. Channels, such as U-Shaped channels, can be present on the intumescent ring, which can complement slots on the housing for adjusting the housing relative to a frame. A cover that surrounds the ring on outside to sandwich the ring in between the housing and the cover can be used. The cover can be made of aluminum and designed to crumple, melt and/or break when the intumescent ring expands.

Provided is a fire resistant recessed lighting assembly comprising: a) a metal housing inside of which a source of light is placed, the metal housing having an open and a closed end; b) an adapter comprised of a flange portion and a tubular portion, the tubular portion configured to be attached to the metal housing at the open end, the flange portion extending radially and outwardly from the open end of the housing; and c) a fire resistant element placed inside of the housing in between the closed end of the housing and the open end of the housing, wherein in an event of a fire, the fire resistant element slows spread of the fire. The lighting assembly can be fire resistant for at least 60 minutes when tested according ASTM E119-12a without a protective fire resistant cover on outside of the housing. The lighting assembly can be fire resistant for at least 120 minutes when tested according ASTM E119-12a without a protective fire resistant cover on outside of the housing. The lighting assembly can further comprise a decorative trim placed inside of the housing in between the fire resistant element and the adapter. The tubular part of the adapter can be complementary to the inside of the open end of the housing, and can be placed inside of the housing. The recessed lighting assembly can be configured to maintain the fire resistant element in the housing in the event of the fire. The fire resistant element can be made from an intumescent material and in the event of the fire, the intumescent material expands to slow spread of the fire. The fire resistant element can be a disc made of the intumescent material. The intumescent disc can have a central opening. The lighting assembly can have a socket in electronic communication with an electric cable from a junction box on outside of the housing is placed inside of the housing, with a least a portion of the socket or the electric cable passing through the central opening of the disc inside of the housing. The housing can have one or more fasteners that cross a wall of the housing in proximity to the second end, the adapter configured to be detachably attached to the fastener. The housing can have one or more slots configured to allow the housing to slide against a frame. The adapter can have a cut portion on the tubular portion that is complementary to the slot. The lighting assembly can further comprise one or more bar hangers attached to the frame configured to allow attachment of the fire resistant recessed lighting assembly to one or more joists. The second end (open end) of the housing and one or more side openings (slots, holes for fasteners) of the housing can be sealed in the event of the fire. In the event of the fire, the fire stop element can expand to fill the housing, the expanded fire stop element configured to remain in the housing in the event of the fire. The intumescent disc can rest on the decorative trim, and move down to seal the opening after a fire.

Provided is a fire resistant recessed lighting assembly comprising: a) a metal housing inside of which a source of light is placed, the metal housing having an open and a closed end; b) an adapter comprised of a flange portion and a tubular portion, the tubular portion configured to be attached to the metal housing at the open end, the flange of the adapter extending outside of the second end of the housing in a direction that is substantially perpendicular to the second end of the housing; c) an intumescent fire stop element placed inside of the housing; wherein in an event of a fire, the fire stop element expands to fill the housing, the expanded fire stop element configured to remain in the housing in the event of the fire.

BRIEF DESCRIPTION OF THE DRAWINGS

FIG. 2A is view illustrating a cutaway portion of the inside of the housing.

FIG. 2B is a close-up of the view illustrated in FIG. 2A.

FIG. 5A is view illustrating a cutaway portion of the inside of the housing.

FIG. 5B is a close-up of the view illustrated in FIG. 5A.

DETAILED DESCRIPTION SECTION OF THE INVENTION

Provided is a fire rated recessed lighting assembly that can contain a fire for at least 60 or 120 hours without the need of a fire box around the recessed lighting assembly. The elimination of the fire box or other fire deterrent construction reduces the cost of installation and allows for the flexibility of arranging the lighting assembly in more locations and closer arrangements. The fire rated recessed lighting assembly is adapted to be disposed in relation to an opening defined in a surface of a structure (i.e. a hole or trough cut into a wall or suspended ceiling) such that a socket (with a lamp or LED strips) can be installed in the light assembly/fixture through the opening.

Figure 1:
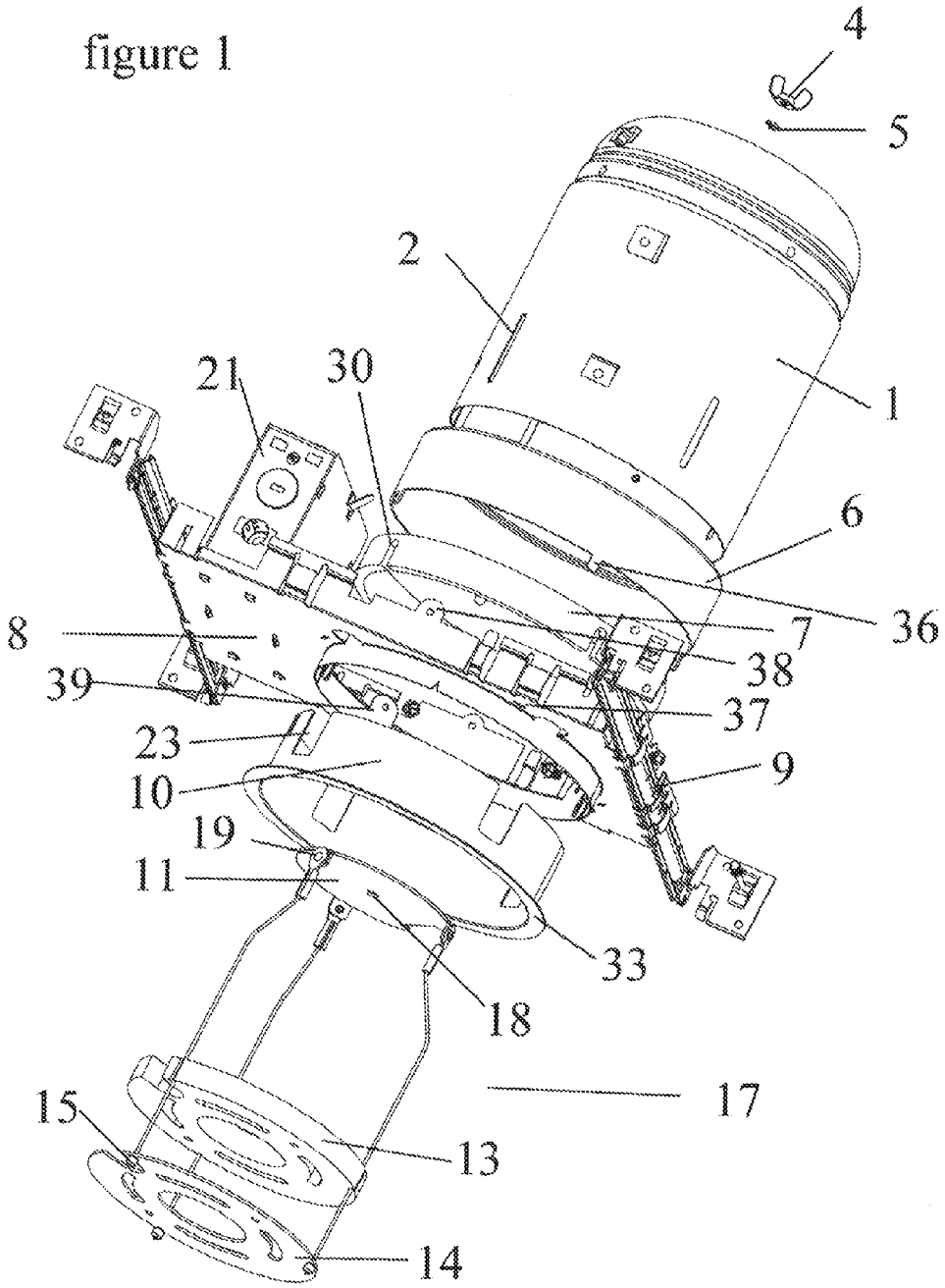
FIG. 1 is an exploded view of the fire rated recessed lighting assembly.

FIG. 1 is an exploded view of the fire rated recessed lighting assembly. The recessed lighting assembly has a housing 1. The housing can be in the shape of a can, with a tubular body with an open end and a closed end. The open end at the bottom of the can is an aperture that generally faces downward. The housing 1 can have a dome shape. The housing 1 can have a slot 2 that allows for adjusting the location of the recessed light in relation to the ceiling. An intumescent ring 7 is fitted over the housing 1. The intumescent ring 7 is placed in proximity of the side openings of the housing 1 which are closer to the open end of the housing 1. These side openings of the housing are slots 2, which allow adjusting position of housing 1 in relation to frame 8. Also shown in FIG. 1 is a cover 6 for the intumescent ring 7. The cover 6 is placed over the intumescent ring 7. Cover 6 is attached to frame 8 through tabs 36. Tabs 36 complement slots 37 on the frame and secure Cover 6 to the frame. The intumescent ring is sandwiched by the housing 1 on the inside and cover 6 on the outside. The lighting assembly can further include an adapter 10 (referred to as support trim in U.S. patent application Ser. No. 14/677,979). Adapter 10 is placed attached to the housing 1 in proximity to the opening of the housing 1 and extends out of the opening of the housing 1, and generally contacts the drywall. Adapter 10 can be made from one piece of metal. Adapter 10 can further include a flange 33. Flange 33 can cover the exposed edges of the drywall in the opening of the structure (e.g. ceiling) into which housing 1 is placed. Flange 33 of the adapter 10 can be adjusted to fit snuggly up against the drywall. Flange 33 can be about 1 cm to about 1.5 cm long, and extend radially in a horizontal manner, from inside of the housing to the outside of the housing. The exposed edges of the drywall are placed in between the flange of adapter 10 and frame 8. The adapter supports the drywall during a fire and acts as a fire barrier sealant and also helps maintaining the drywall in place in the event of a fire. The tubular portion (of hollow circular shape) of adapter 10 can have a height of about 3 cm to about 5 cm. The adapter 10 can further include a cut portion 23 on its tubular portion (1, 2, 3, or 4 cut portions). Cut portion 23 can be rectangular in shape, with one side of the rectangle forming a continuous line with the top of the tubular portion of adapter 10. Cut portion 23 complements slot 2 of housing 1. These are four slots 2, each having a screw 22 that is used to adjust the height of the light fixture as shown. Adapter 10 can be attached to the housing 1 through groove 20 (illustrated in FIG. 2A) on the tubular portion of adapter 10. The diameter of adapter 10 is such so that it can be placed inside of the housing 1, and rotated so that a complementary screw on the inside of the housing 1 holds adapter 10 in place through groove 20. The adapter 10 can be attached to screw 24 of the lighting assembly.

Cut portion 23 can be configured to have a width (along the periphery of adapter) that is less than the width of groove 20. The width of the cut portion 23 can be 1.4 to 2 centimeters. Groove 20 can have an initial vertical cut portion followed by a non-vertical portion. The width of the groove in the vertical portion can be 0.3 cm to 0.7 cm.

Sub-assembly 17 is placed inside of the housing 1. Sub-assembly 17 includes bracket 11, wire 12, and support 14. Support 14 supports the weight of intumescent disc 13 that is placed on the top of support 14. Support 14 and intumescent disc 13 can be attached to each other with a fastener or a rivet. Bracket 11 is attached to a plurality of wires 12 through connectors 19. The wires pass through tracks 32 (FIG. 6) on the intumescent disc and then through opening 31 (FIG. 8) on support 14. The wires 12 are held in place by stopper 15. Sub-assembly 17 is attached to housing 1. The attachment can be done by fastening bracket 11 to the top of the housing 1. A complementary screw hole 18 aligns with a hole on housing 1 and is fastened with butterfly nut 4 and washer 5. In another embodiment, the bracket 11 is riveted to the top of the housing 1.

FIGS. 2A and 2B are a side perspective view of the recessed lighting assembly. As illustrated, a light has not been placed inside housing 1. Bracket 11 has been attached to the top of the housing 1. Wires 12 are supported by the bracket 11. The intumescent disc 13 is resting on support 14. The adapter 10 has been placed inside of the housing 1 through placing screw 24 of the housing 1 inside of groove 20 of adapter 10. The cut portion 23 of adapter 10 accommodates slot 2 and a screw 22 or other fastening means that attaches housing 1 to frame 8. Also shown in FIG. 2A is junction box 21 which is attached to frame 8. Also illustrated are hangers 9 for attaching the recessed lighting assembly to a joist.

The close up in FIG. 2B shows intumescent ring 7 placed inside cover 6. On the outside of the intumescent ring 7 cover 6 is placed. The intumescent ring 7 circles housing 1 on the outside of housing 1 in close proximity to the bottom opening of housing 1. Intumescent ring 7 has a plurality of channels 30, which can U shaped. These U-shaped channels 30 fit over slots 2 of housing, and allow for fastening a fastener at any location in slots 2 without moving intumescent ring 7. After a manufacturer installs intumescent ring 7, there is no need to move intumescent ring 7 when an adjustment needs to be made when fastening housing 1 through slots 2. The role of the intumescent ring 7 is to close lateral openings of the housing, such as slot 2, in the event of a fire.

Figure 3:
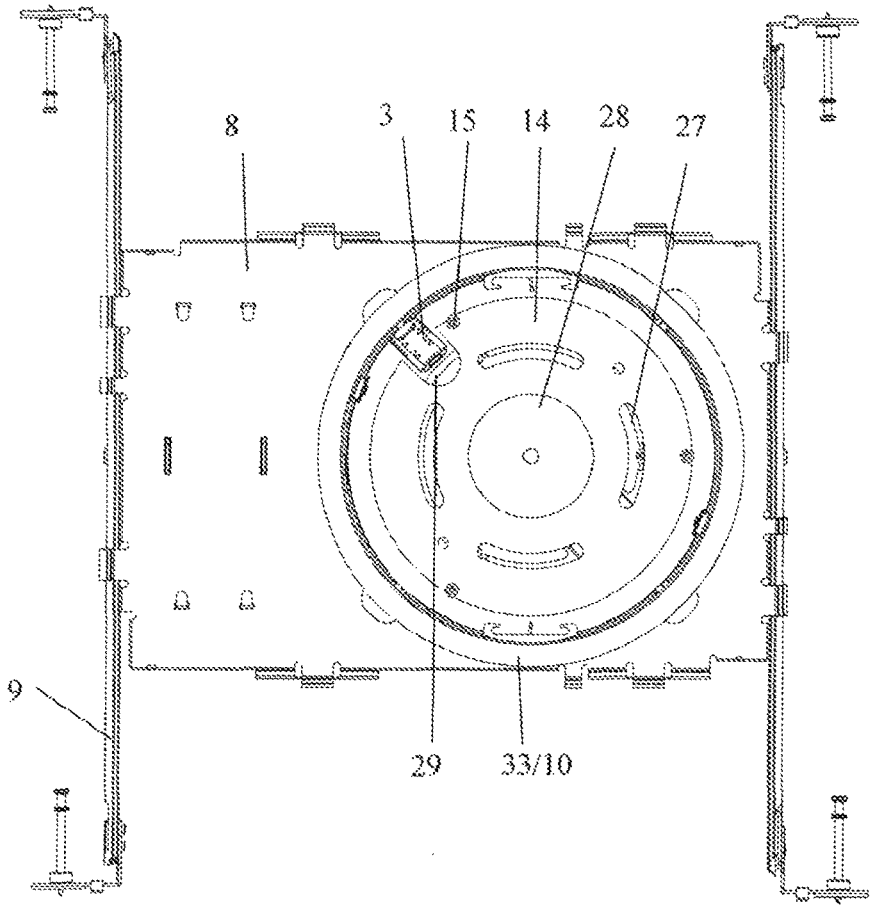
FIG. 3 is a bottom view of the fire rated recessed lighting assembly.

FIG. 3 is a bottom of the lighting assembly (without a light). The lighting assembly is shown with housing 1 attached to frame 8, which has hanger bars 9. Flange 33 of adapter 10 is visible in this view. Also shown is support 14 on top of which intumescent disc 13 rests. Support 14 has a central opening 29. Intumescent disc 13 has the same complementary central opening 29. Electric cable 3 enters housing 1 from side of the housing 1 and in proximity to the top end of the housing 1. Support 14 and intumescent disc 13 have indentation 29 to accommodate the electric cable 3 entering housing 1. Also shown is stopper 15 keeping support 14 in place and not allowing it to fall out due to gravity. Support 14 is illustrated with heat vent 27.

Figure 4:
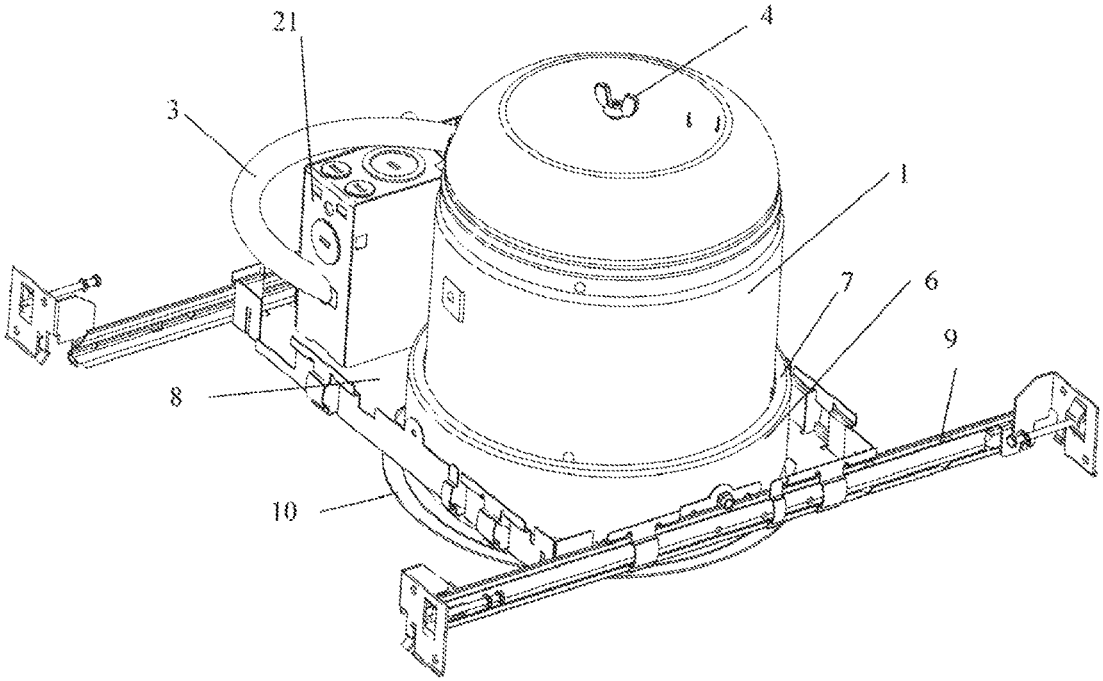
FIG. 4 is a top perspective view of the fire rated recessed lighting assembly.

FIG. 4 illustrates a top perspective view of the recessed lighting assembly. Illustrated are housing 1, which is attached to frame 8. Hangers 9 are also attached to frame 8. An electric cable 3 runs from junction box 21 to housing 1. Intumescent ring 7 circles housing 1 on the outside where slot 2 is present. Cover 6 surrounds and covers intumescent ring 7. Cover 6 also has the overall shape of a ring. Illustrated on the top of the housing is butterfly nut 4 for attaching bracket 11 to top of housing 1. Instead of butterfly nut 4, another type of nut, other fastening means, or a rivet can be used.

FIGS. 5A and 5B illustrate a cutaway view of inside of housing 1. These figures also show a socket 26 and decorative trim 16 placed inside of housing 1. When a person views the light assembly, the person generally sees decorative trim 16 placed inside of housing 1 surrounding a light source. The light source that is attached to the socket can be any typical light source, such as LED (light Emitting Diode), incandescent, or fluorescent. In case of an LED light, flat LED strips can be attached to surface of socket 26. For incandescent or fluorescent light source, socket 26 can be a traditional socket with threading for receiving a lamp. An LED lamp with threading can also be used. Intumescent ring 13 and support 14 rest on the back side of decorative trim 16. Socket 26 passes through the central opening 28 from one side of the intumescent disc 13/support 14 to the other side. The intumescent disc 13/support 14 rest on decorative trim 16 placed inside of housing 1. When an electric cable enters housing 1, the electric cable is placed in the space formed between top end of housing 1 and intumescent disc 13. The electric cable 3 is connected to socket 26 in this space.

In the event of a fire, the decorative trim 16 and other parts of the lighting unit, which are made of aluminum, melt. Intumescent ring 13 also expands. The melting of decorative trim 16 and expansion of intumescent 13 causes a downward force on support 14. Support 14 slides down through wires 12 until the point in which it is stopped by stoppers 15, obtaining the position shown in FIG. 2. The downward movement of support 14 protects housing 1 from damage and removes any fire inside housing 1. Additionally, any fire has no chance of spreading upwards because the intumescent disc 13 protects the top of housing 1. When intumescent disc 13 expands, it will no longer have central opening 28 and will occupy the substantial volume of housing 1. Intumescent disc 13 is designed to substantially fill the entire space of housing 1. The intumescent disc 13 can fill at least 25%, or at least 50%, or at least 70%, or at least 90% of the entire space of housing 1. The intumescent disc 13 can increase its volume by at least 50%, or at least 100%, or at least 300% or more. Similarly, intumescent ring 7 expands in a fire. The intumescent ring 7 covers slot 2 and any other side opening present in housing 1. Cover 6 is made of aluminum and is designed to crumple when intumescent ring 7 expands in a fire. Housing 1 is sealed by the intumescent ring 7 and intumescent disc 13 in the event of a fire, not providing access to flames from anywhere other than the aperture of Housing 1.

In an embodiment, housing 1, wire 12, stopper 15, support 14, nut 4 (or rivets), bracket 11, steel trim 10, frame 8, connector 19, and all fasteners/rivets are made of steel or other material that is designed not to melt in the event of a fire. The fasteners can further be zinc plated to impart a shiny look to the fasteners.

Figure 6:
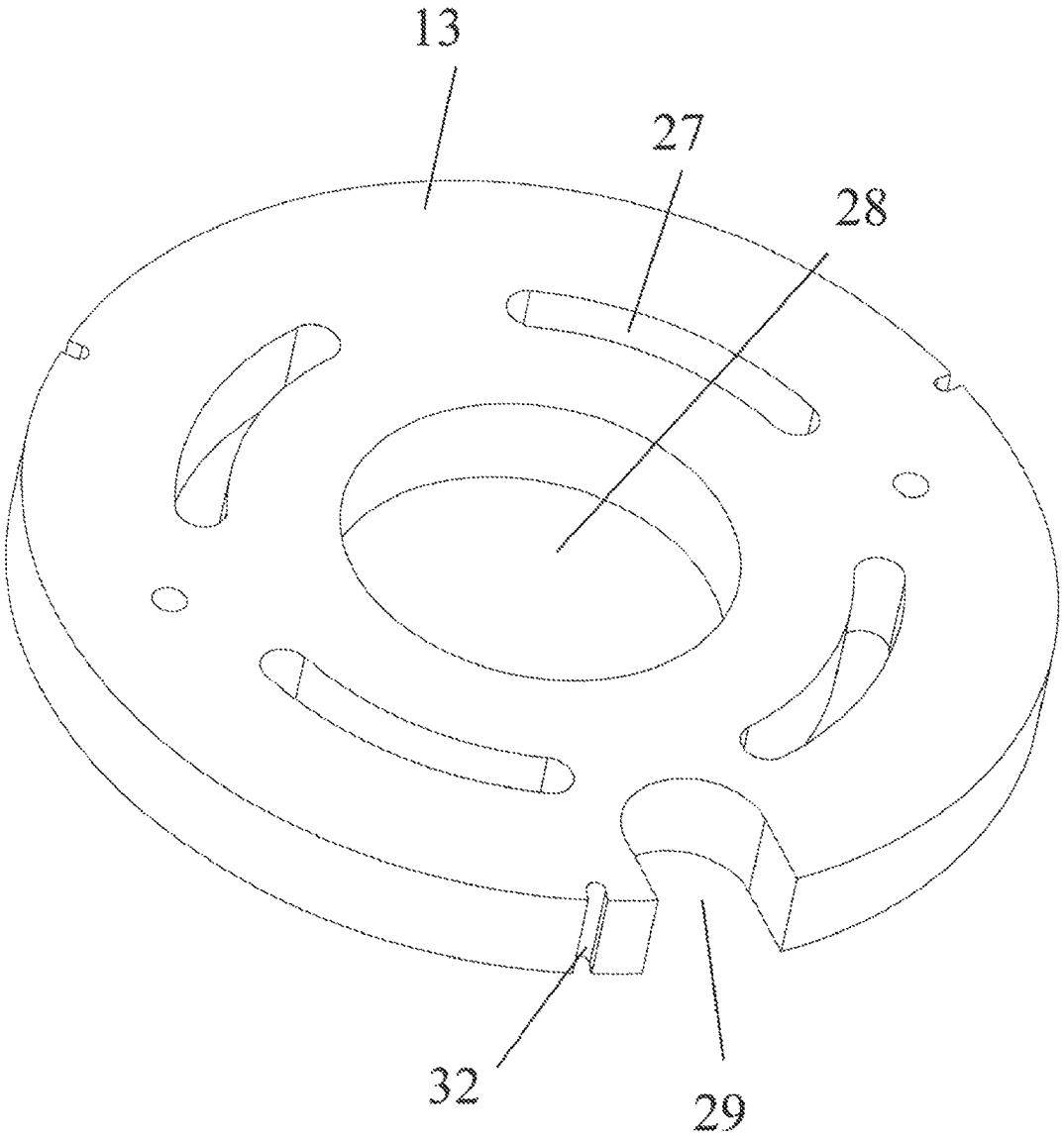
FIG. 6 is a top perspective view of an intumescent disc.

FIG. 6 is a perspective view of intumescent disc 13. Heat vents 27 allow for movement of air during ordinary use. Heat vents 27 as illustrated in FIG. 6 have a profile where the heat vents are annular. The sides of the heat vents 27 have the same degree of curve as the periphery of the disc 14. The heat vents 27 can all have identical shapes/areas, and can be spaced equidistant from each other and/or the periphery of the disc 13 (or disc 14), and equidistant from the central opening 24. Central opening 28 allows for placement of socket 26. Indentation 29 accommodates electric cable 3 at the point of entrance to housing 1. Tracks 32 allow for sliding against wires 12. Metal disc 14 has the same profile as the intumescent disc 13.

Figure 7:
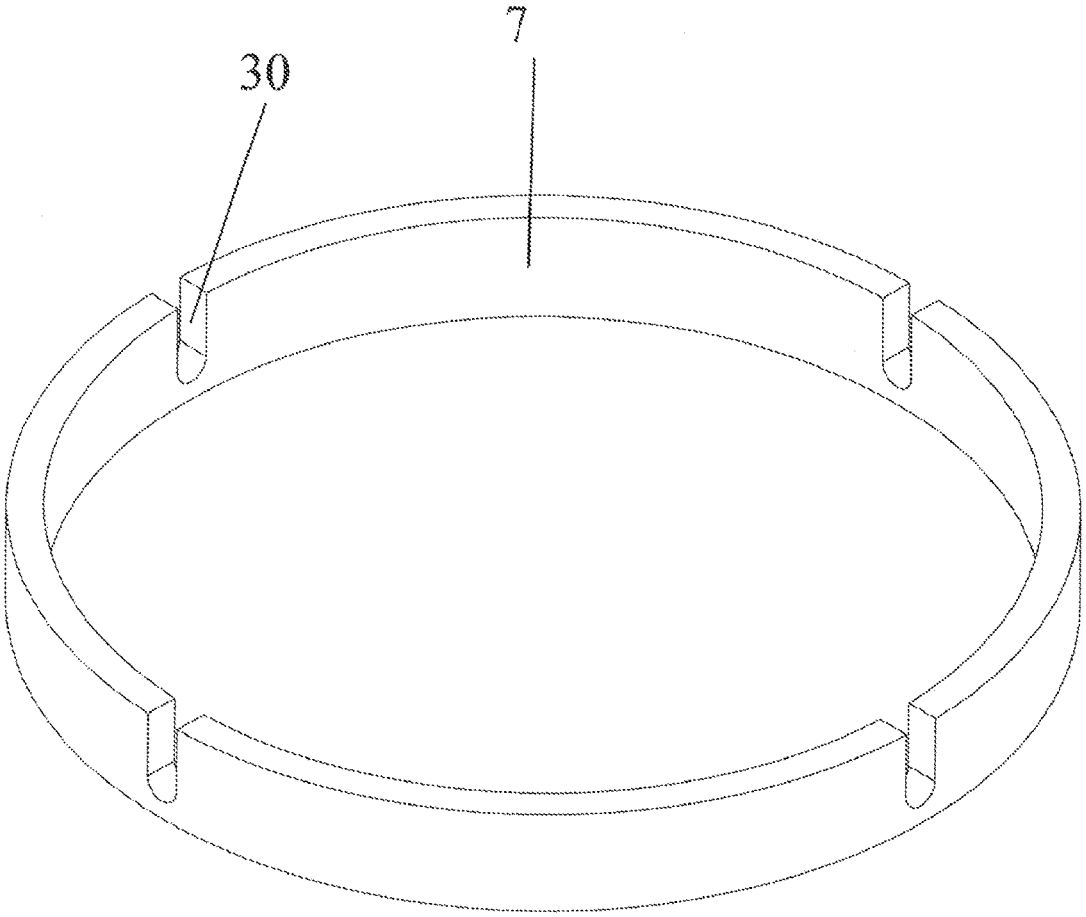
FIG. 7 is a top perspective view of an intumescent ring.

FIG. 7 is a top perspective view of intumescent ring 7. Intumescent ring 7 has a diameter that complements the diameter of housing 1. Intumescent ring 7 also has indentation that allow for placing the ring around screws or other fastening means. Intumescent ring 7 covers the lateral openings (slots 2) of housing 1 intended to attach housing 1 to frame 8

Figure 8:
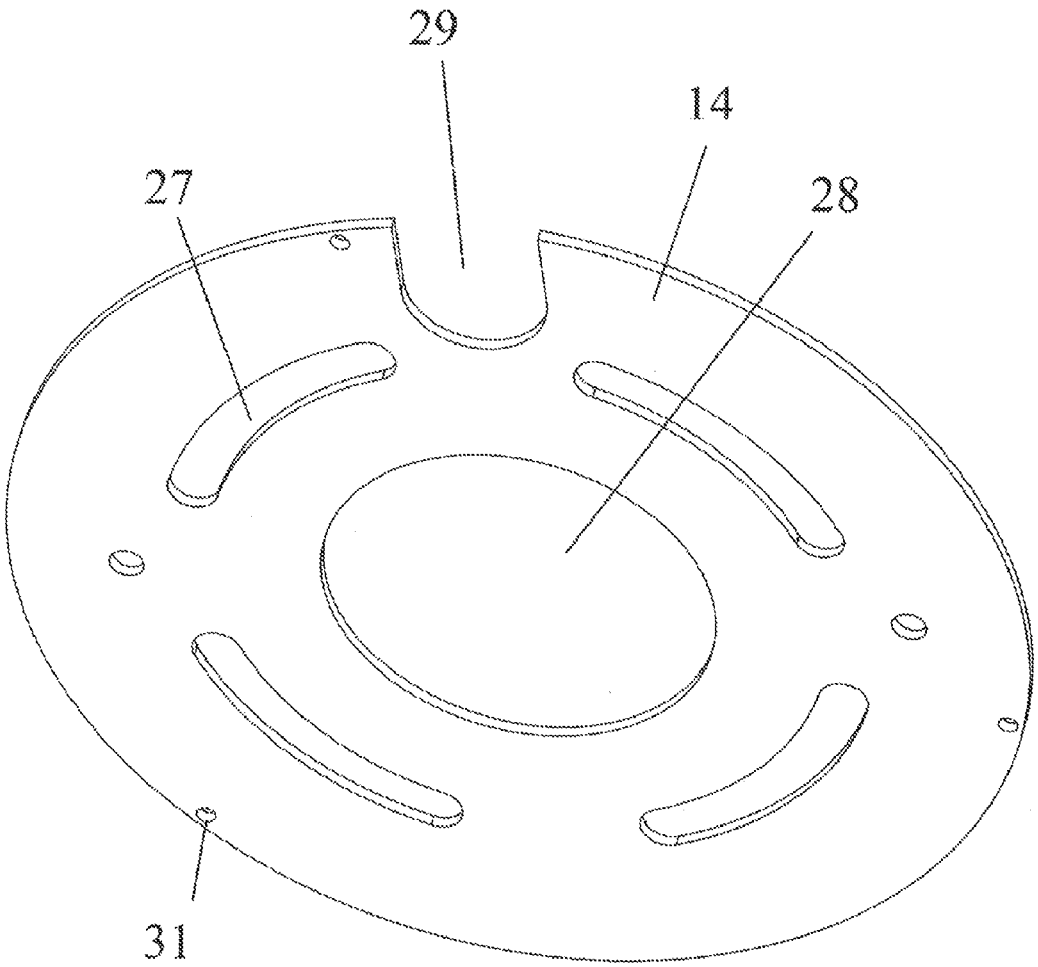
FIG. 8 is a top perspective view of a thin steel support in the shape of a disc.

FIG. 8 is a perspective view of support 14, which is typically made of a thin sheet of steel, which does not melt during a fire for at least 60 or 120 minutes. Heat vents 27 allow for movement of air during ordinary use (non-fire event). Central opening 28 allows for placement of socket 26. The socket 26 is loose as illustrated and not attached to housing 1. Alternatively, socket 26 can be attached to housing 1 or support disc 14. Indentation 29 accommodates electric cable 3 at the point of entrance to housing 1. Openings 3 allow for sliding against wires 12. Opening 31 is designed so that it be smaller than stopper 15, and keep support 14 in place when wires 12 are fully extended.

Figure 9A:
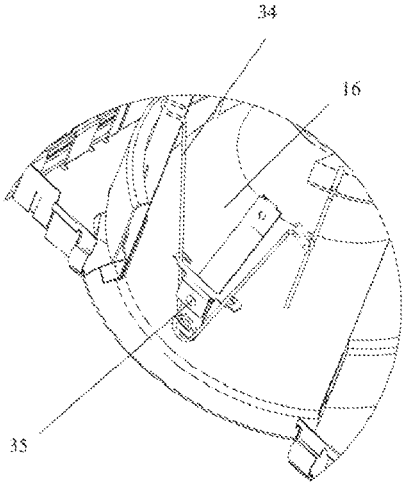
FIG. 9A is a close-up of FIG. 9B illustrating how a lighting unit is secured.
Figure 9B:
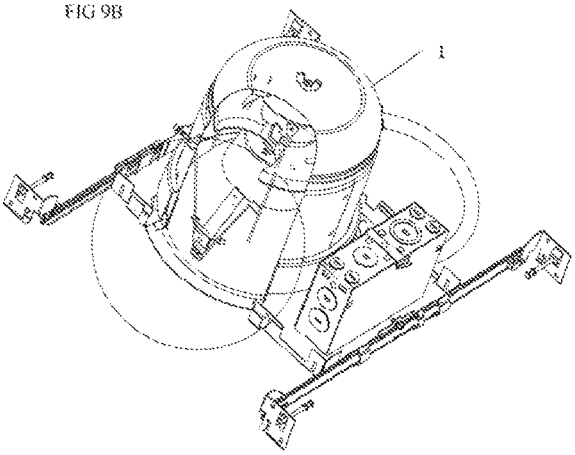
FIG. 9B illustrates how a lighting unit is secured.

FIGS. 9A and 9B illustrate how decorative trim 16 is kept in place. As illustrated, in this embodiment, the lighting unit has clips 34 that are held in place by a clip holder 35 that is attached to inside of housing 1. The clips 34 exhibit spring-like elastic movement, and press against clip holder 35.

The lighting assembly of the present invention can be manufactured in different sizes, including sizes that allow for 4 inch, 5 inch, and 6 inch aperture (which correspond approximately to the diameter of the opening of the can).

Support Disc 14 can have a thickness of about 1 mm to about 3 mm such as about 1.6 mm thickness. Support Disc 14 can have a diameter of about 110 mm to about 150 mm, such as about 132 mm. Intumescent disc 13 can have a thickness of about 10 to about 15 mm, such as about 12.8 mm. Intumescent disc 13 can have a diameter of about 110 mm to about 150 mm, such as about 132 mm. Intumescent disc 13 can have a central opening of about 40 mm to about 60 mm, such as about 51 mm. Intumescent ring 7 can have a diameter of about 150 mm to about 200 mm, such as about 171.5 mm (when measures from outside-Inside diameter is 159.5 mm), thickness of about 4 mm to about 8 mm such as about 6 mm, length of about 15 mm to about 25 mm, such as about 19 mm, and U channel length of about 10 mm to about 15 mm, such as about 12 mm.

Figure 10:
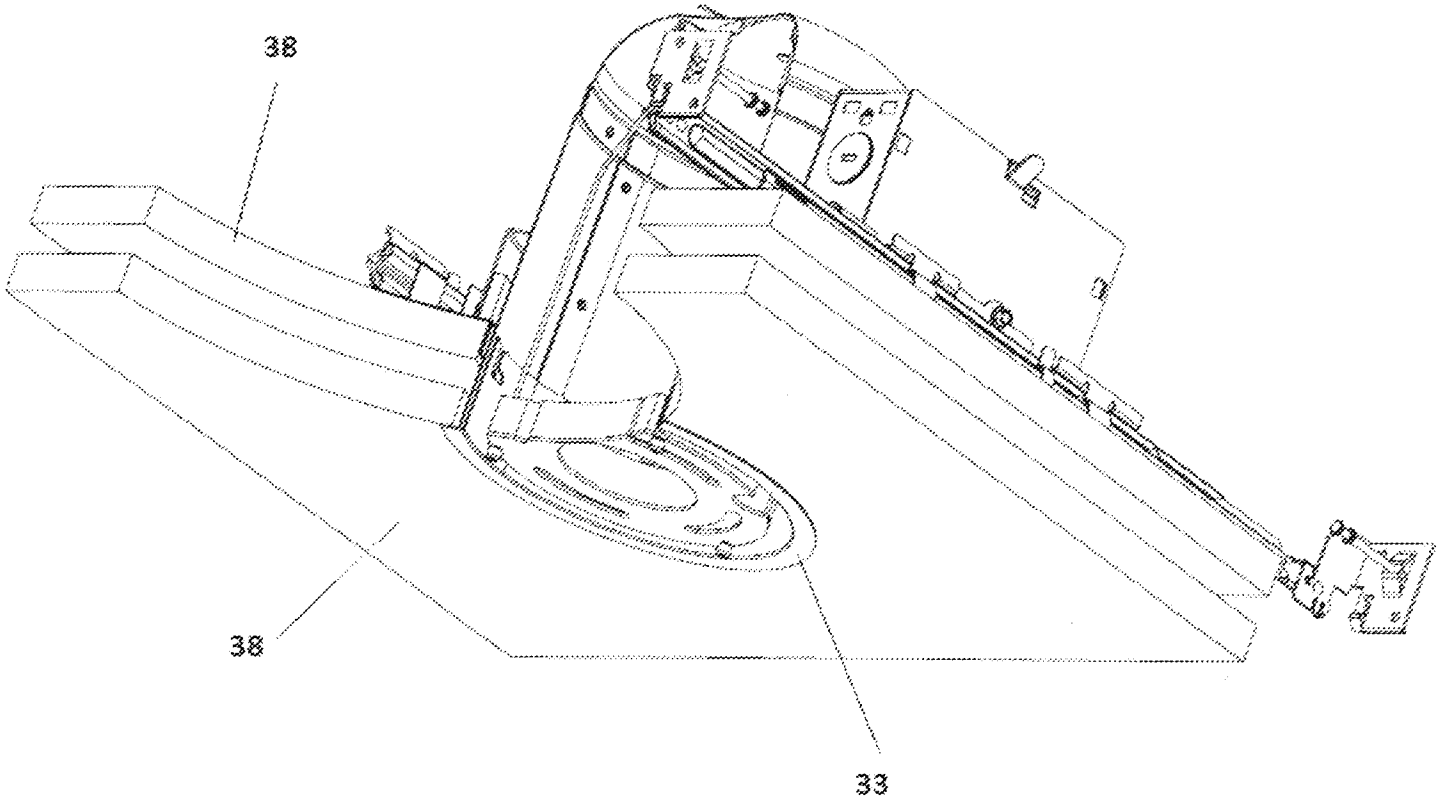
FIG. 10 illustrates a lighting unit in contact with two drywalls, with the lower drywall resting on the flange of the adapter.
Figure 14:
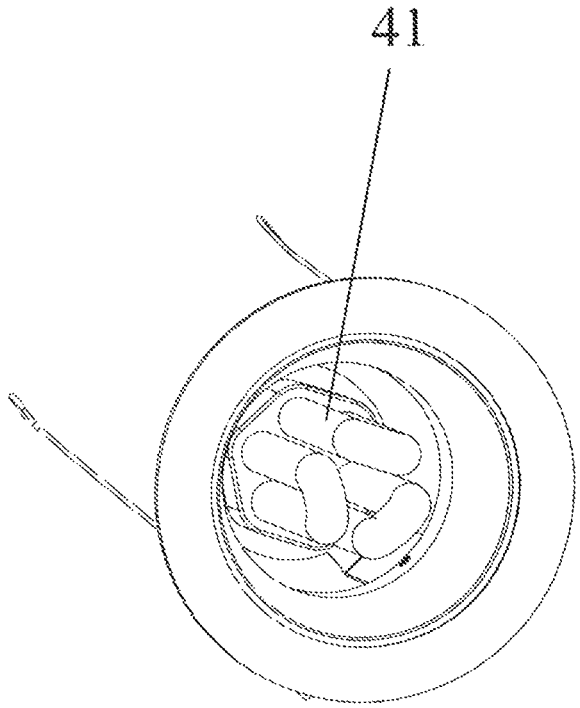
FIG. 14 illustrates a Compact Fluorescent light source for placing inside of the housing.

FIG. 10 illustrates drywall 38 resting on top of flange 33. As illustrated the particular ceiling has two drywalls 38, and the lower drywall 38 rests on flange 33. FIG. 14 illustrates a top perspective view of the lighting assembly interacting with drywall 38. The drywall 38 is placed under frame 8.

Figure 11:
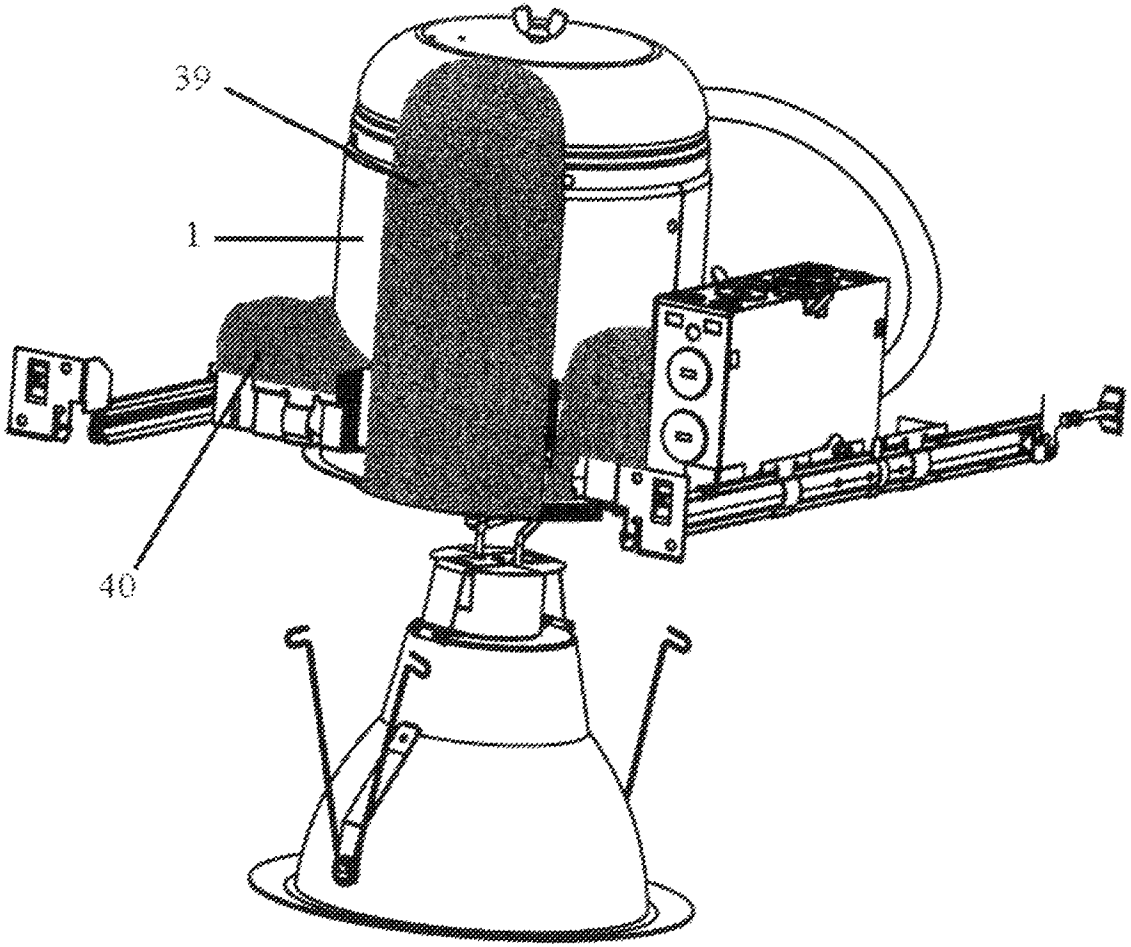
FIG. 11 illustrates a housing that is filled and sealed with the intumescent material after a fire.
Figure 12:
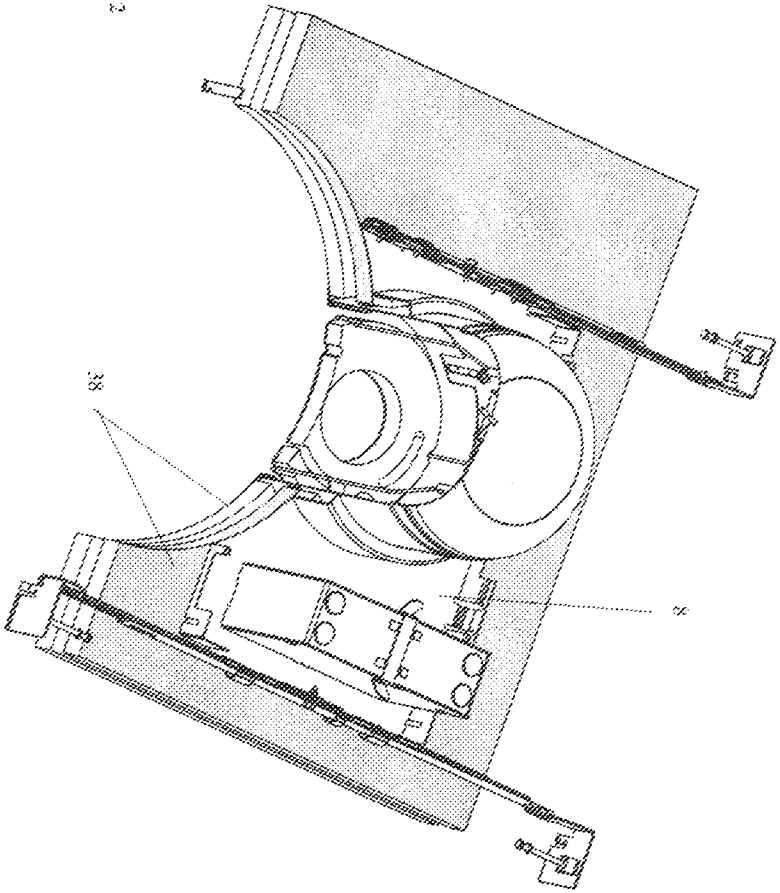
FIG. 12 illustrates a lighting unit in contact with two drywalls, with the upper drywall resting below the frame.

FIG. 11 illustrates expansion of the intumescent material in the event of a fire. Inside the housing 1 is expanded (charred) intumescent material 39 from the intumescent disc 13, which seals the inside of housing 1, particularly the lower opening, and fills substantially the entire space inside of housing 1. The charred intumescent material is configured to stay inside of housing 1 and is supported by support/metal disc 14. Outside of the housing 1 is expanded (charred) intumescent material 40 from the intumescent ring 7, which seals the slots 2 and other screw holes on the side of housing 1.

Figure 13:
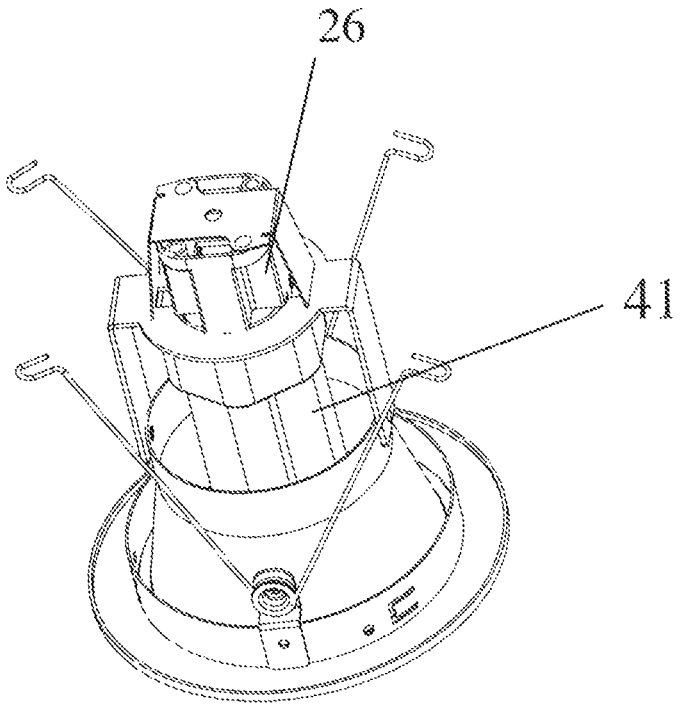
FIG. 13 illustrates a Compact Fluorescent light source for placing inside of the housing.

FIGS. 13 and 14 illustrated a compact fluorescent 41 light source that is placed inside of housing 1. The light source can be attached to a socket 26 that is held with a bracket. The weight of discs 13 and 14 can be supported by the bracket.

Figure 15:
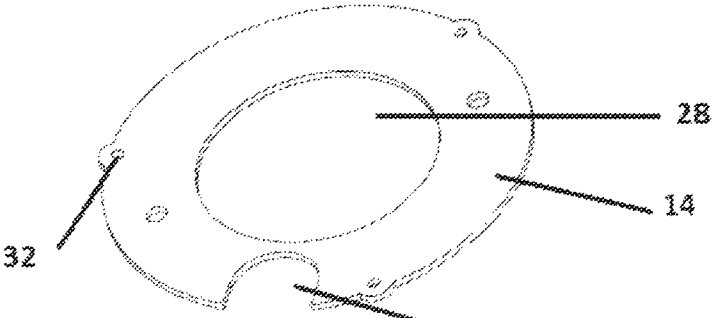
FIG. 15 illustrates a metal disc for placing inside a 4 inch housing.
Figure 16:
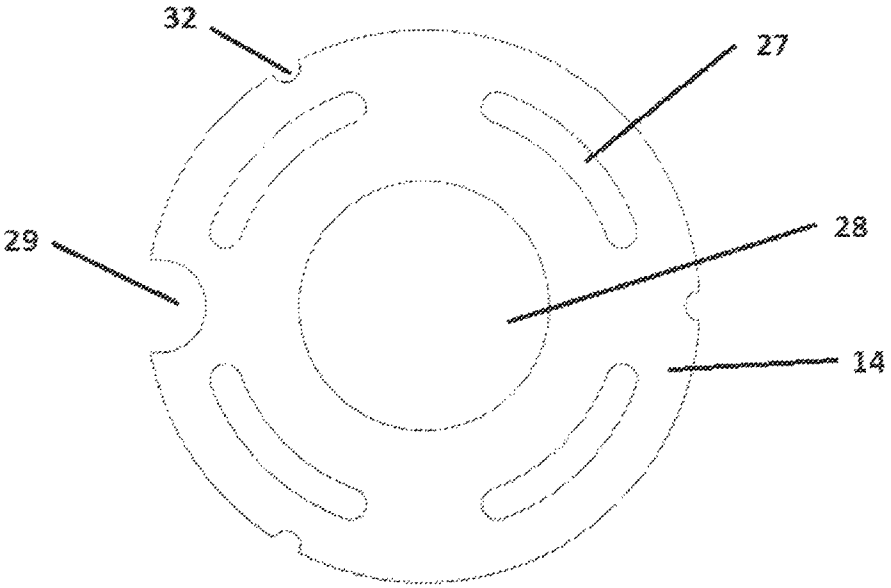
FIG. 16 illustrates a metal disc for placing inside a 5 inch housing.

FIGS. 15 and 16 illustrate different shapes of metal disc 14. FIG. 15 illustrates a metal disc 14 for a lighting assembly with a 4 inch aperture. The metal disc 14 is substantially flat and lacks heat vents (openings), and has an indentation 29 (round shaped) on the outside passage of wires, and a circular opening 28 on the inside. FIG. 16 illustrates a metal disc 14 for a lighting assembly with a 5 inch aperture. The metal disc 14 has a plurality of heat vents 27 that are annular. The sides of the heat vents 27 have the same degree of curve as the periphery of the disc 14, and are equidistant from the periphery of the disc and from each other. The metal disc 14 also has an indentation 29 (round shaped) on the outside passage of cables, and a circular opening 28 on the inside. The intumescent disc 13 have the same profile as metal disc 14, but is thicker. The disc illustrated in FIG. 6 is configured for a 6 inch aperture.

Testing of the lighting assembly for fire rating can be conducted in accordance with the applicable requirements of, and following the standard methods of, ASTM E119-12a (version 14, incorporated herein by reference) Standard Test Methods for Fire Tests of Building Construction and Materials. For example, a 6 inch aperture lighting assembly can be tested as is that shown in FIG. 1. The lighting assembly can be installed in a large scale horizontal furnace in a UL L505 ceiling/floor type construction assembly and tested to the standard time-temperature curve described in the E119 standard. A lighting assembly as illustrated in FIG. 1 can be fire rated according to these standards.

According to WO2004039916, incorporated herein by reference, conventional fire resistant materials may be divided into different categories including: Halogen based: which consist of either brominated or chlorinated chemicals such as brominated polystyrene or phenylene oxide (Dead Sea Bromine or Great Lakes CC) or bis (hexachlorocyclopentadieno) cyclooctane (Occidental CC). Phosphorus based: which consist of a range of different chemistries from elemental phosphorus (Clarient), phosphonates (A&W antiblaze 1045), phosphonate esters (Akzo Nobel), phosphites, phosphates and polyphosphates including melamine phosphite and phosphate, ammonium and melamine polyphosphate (DSM Melapur). Nitrogen based: such as melamine and its salts (U.S. Pat. No. 4,511,684 Schmidt & Hoppe). Intumescent agents: incorporating (i) an acid source (carbonization catalyst) such as ammonium polyphosphate; (ii) a carbonization reagent e.g. polyhydric alcohols such as pentaerythritol; and (iii) a blowing reagent like melamine. Expandable graphite is also known to undergo thermal expansion on addition of heat. Inorganic additives: such as magnesium hydroxide and aluminum hydroxide (Martinswerk), zinc borate (Fire Brake ZB, US Borax) and antimony trioxide.

Examples of intumescent materials are provided for example in U.S. Pat. No. 7,320,536, which is incorporated herein by reference.

The diameter of the can of the light fixture can be approximately 4 inches, 5, inches, or 6 inches, when measured at the open end of the can (housing). The light source can be incandescent, Compact Fluorescent (CFL) 41, or LED (Light Emitting Diode). The housing 1 can have a height of 8 inches or less.

REFERENCES

1. Housing
2. Slot
3. Electric cable
4. Butterfly nut
5. Washer
6. cover
7. intumescent ring
8. frame
9. hangers
10. adapter
11. bracket
12. wire
13. intumescent disc
14. support (metal disc)
15. stopper
16. decorative trim
17. sub-assembly
18. bracket opening
19. connector
20. adapter groove
21. junction box
22. Slider screw
23. Cut Portion
24. Groove screw
25. Bracket screw
26. Socket
27. Heat Vent
28. Central opening
29. Indentation for electric cable
30. Channel
31. Opening
32. Tracks
33. Flange of adapter
34. Clips
35. Clip Holder
36. Tab
37. Slots for tabs
38. Drywall
39. Intumescent disc after a fire (charred)
40. Intumescent ring after a fire (charred)
41. Compact Fluorescent light source

What is claimed is:

1. A fire resistant recessed lighting assembly comprising:

a) a metal housing inside of which a source of light is placed, the metal housing having an open and a closed end;

b) a member comprised of a flange portion and a tubular portion, the tubular portion configured to be attached to the metal housing at the open end, the flange portion extending radially and outwardly from the open end of the housing, the member configured to contact a ceiling in which the recessed lighting assembly is installed;

c) a trim placed inside of the housing in between the open end and the close end of the housing;

d) a socket placed inside of the housing configured to receive a source of light;

e) a fire resistant disc placed inside of the housing in between the closed end of the housing and the trim, the fire resistant disc having a central opening configured for passage of the socket or an electric cable, wherein the fire resistant disc is composed of a material selected from the group consisting of one or more of halogen based, phosphorous based, graphite, and intumescent; and f) a metal disc placed inside of the housing in between the trim and the fire resistant disc, the metal disc having a central opening configured for passage of the socket or the electric cable, the metal disc configured to maintain the fire resistant disc in the housing in an event of the fire.

2. The fire resistant recessed lighting assembly of claim 1, wherein the lighting assembly is fire resistant for at least 60 minutes when tested without a protective fire resistant cover on outside of the housing.

3. The fire resistant recessed lighting assembly of claim 1, wherein the lighting assembly is fire resistant for at least 120 minutes when tested without a protective fire resistant cover on outside of the housing.

4. The fire resistant recessed lighting assembly claim 1, wherein the tubular part of the member is complementary to an inside of the open end of the housing, and is placed inside of the housing.

5. The fire resistant recessed lighting assembly of claim 1, wherein the fire resistant element is made from the intumescent material and in an event of the fire, the intumescent material expands.

6. The fire resistant recessed lighting assembly of claim 1, wherein the housing has one or more fasteners that cross a wall of the housing in proximity to the open end, the member configured to be detachably attached to the fastener.

7. The fire resistant recessed lighting assembly of claim 1, wherein the housing has one or more slots configured to allow the housing to slide against a frame.

8. The fire resistant recessed lighting assembly of claim 7, wherein the member has a cut portion on the tubular portion that is complementary to the slot.

9. The fire resistant recessed lighting assembly of claim 7, further comprising one or more bar hangers attached to the frame configured to allow attachment of the fire resistant recessed lighting assembly to one or more joists.

10. The fire resistant recessed lighting assembly of claim 1, wherein the open end of the housing and one or more side openings of the housing are sealed in an event of a fire.

11. The fire resistant recessed lighting assembly of claim 1, wherein in an event of the fire, the fire resistant disc expands to till the housing, the expanded fire stop element configured to remain in the housing in an event of a fire.

12. The fire resistant recessed lighting assembly of claim 1, wherein the metal disc has a diameter of 110 mm to 150 mm.

13. The fire resistant recessed lighting assembly of claim 1, wherein the metal disc has a thickness of 1 mm to 3 mm.

14. The fire resistant recessed lighting assembly of claim 1, wherein the tubular portion has a height of 3 cm to 5 m.

15. The fire resistant recessed lighting assembly of claim 1, wherein the flange has a length of 1 cm to 1.5 cm.

16. A fire resistant recessed lighting assembly comprising:

a) a metal housing inside of which a source of light is placed, the metal housing having an open and a closed end, the metal housing having one or more slots in proximity to the open end;

b) a frame adjustably attached to the metal housing through the slots;

c) a member comprised of a flange portion and a tubular portion, the tubular portion configured to be attached to the metal housing at the open end, the flange portion extending radially and outwardly from the open end of the housing, the member having cut portions in the tubular portions that complement the slots on the housing;

d) a trim placed inside of the housing in between the open end and the close end of the housing, e) a socket placed inside of the housing configured to receive a source of light;

f) a fire resistant disc placed inside of the housing, the fire resistant disc having a central opening configured for passage of the socket or an electric cable, wherein the fire resistant disc is one or more of halogen based, phosphorous based, graphite, and intumescent;

g) a metal disc placed inside of the housing in between the trim and the fire resistant disc, the metal disc having a central opening configured for passage of the socket or the electric cable, the metal disc configured to maintain the fire resistant disc in the housing in an event of a fire; and h) one or more bar hangers attached to the frame configured to allow attachment of the fire resistant recessed lighting assembly to a support structure.

* * * * *